US007057565B1

(12) United States Patent
Liu

(10) Patent No.: US 7,057,565 B1
(45) Date of Patent: Jun. 6, 2006

(54) MULTI-BAND FLAT ANTENNA

(76) Inventor: Cheng-Fang Liu, No. 243, Yong-An Rd., Meinong Township, Kaohsiung Hsien (TW)

( * ) Notice: Subject to any disclaimer, the term of this patent is extended or adjusted under 35 U.S.C. 154(b) by 0 days.

(21) Appl. No.: 11/108,414

(22) Filed: Apr. 18, 2005

(51) Int. Cl.
*H01Q 1/38* (2006.01)
*H01Q 1/24* (2006.01)

(52) U.S. Cl. ..... 343/700 MS; 343/702; 343/895

(58) Field of Classification Search ..... 343/700 MS, 343/895, 702, 893
See application file for complete search history.

(56) References Cited

U.S. PATENT DOCUMENTS 5,541,610 A * 7/1996 Imanishi et al. ..... 343/702
5,798,737 A * 8/1998 Kanaba et al. ..... 343/895
5,818,398 A * 10/1998 Tsuru et al. ..... 343/895
5,870,065 A * 2/1999 Kanba et al. ..... 343/895
5,933,116 A * 8/1999 Suesada et al. ..... 343/702
6,028,568 A * 2/2000 Asakura et al. ..... 343/895
6,064,351 A * 5/2000 Mandai et al. ..... 343/873
6,075,491 A * 6/2000 Dakeya et al. ..... 343/722
6,958,728 B1 * 10/2005 Liu ..... 343/700 MS

* cited by examiner

*Primary Examiner*—Trinh Vo Dinh
(74) *Attorney, Agent, or Firm*—Jackson Walker, LLP

(57) ABSTRACT

A multi-band flat antenna has multiple compressed dielectric substrates on which printed circuits are formed and interconnected to constitute first, second and third radiation units to supply three frequency bands. The first radiation unit is created by multiple circuits of different shapes that are interconnected to form a three-dimensional configuration. The second radiation unit is created by an L-shaped circuit and electrically connects to the first radiation unit at a common feeding node. The third radiation unit is formed by a crooked conductive wire. With the foregoing configuration, the size is minimized as far as possible. By properly adjusting the circuit length of the first/third radiation units as well as the second radiation unit, it is easy to acquire a desired resonance frequency value and ratio.

20 Claims, 14 Drawing Sheets

MULTI-BAND FLAT ANTENNA

BACKGROUND OF THE INVENTION

1. Field of the Invention

The present invention relates to a multi-band flat antenna, and more particularly to a flat antenna having a meandering configuration constructed in such a way that conductive traces are printed on multiple layers of dielectric substrates and electrically connected by a plated through hole (PTH) process. The flat antenna is suitable for use in any wireless equipment such as a wireless mobile phone, a wireless modem or for use in a local area network (LAN).

2. Description of Related Art

The rapid developments in the wireless communication field have led to a variety of new communication apparatuses and technologies in recent years. Basically, these communication products are required to be multi-functioning in a miniature size. Such requirements are also applied to wireless antenna used with the new communication products. For the third generation wireless format (3G), it is particularly necessary to develop a novel antenna that can satisfy requirements of being multi-functioning, multi-band and compact. Actually, many manufacturers in this field have continuously proposed different antenna.

With reference to FIG. 1, an antenna (60) capable of providing dual operation bands includes a long conductive wire (61) and a short conductive wire (62) apart from the long conductive wire (61) by a distance. Two distal end of the wires (61)(62) are in the open circuit status, but the other ends of which are commonly connected by a feeding port (63). The long conductive wire (61) is operated at a low frequency, for example 900 MHz, while the short conductive wire (62) is operated at a high frequency, for example 1800 MHz. Although the antenna (60) can be operated at two different bands, the antenna is still practical to be integrated in the small communication products because the length of the wire (61) is too great.

With reference to FIG. 2, to solve the length problem of the above-mentioned antenna, a flat antenna structure consisting of a substrate (70) on which a meandering radiator (71) is proposed. Another alternative type is shown in FIG. 4, wherein a conventional chip antenna is formed by a spiral conductive wire (81) embedded in a solid substrate (80). Using the antennae of FIGS. 2 and 4, the foregoing wire (61) for the low operation band in the dual antenna (60) is able to be replaced by either type. For example, a first meandering radiator (71) and a second radiator (72) are created on a flat substrate (70) as shown in FIG. 3, or a spiral conductive wire (81) and a second wire (82) are formed inside a substrate (61) to provide different operation bands. However, the size of these antennae still can not be effectively miniaturized to meet the desired requirement.

Besides the aforementioned miniature size requirement, a wireless antenna needs to encompass multiple channels and be able to support wide operation frequency bandwidth. For example, some established operation frequency standards may include EGSM (880–960 MHz), DCS (1710–1880 MHz), PCS (1850–1990 MHz), WCDMA/CDMA2000 (1920–2170 MHz), IEEE802.11b (2.4–2.4835 GHz). These standards can be mainly categorized into some groups based on an operation frequency band, i.e. a first operation frequency band (880–960 MHz) with 80 MHz bandwidth, a second operation frequency band (1710–2170 MHz) with 460 MHz bandwidth, and a third operation frequency band (2.4–2.4835 GHz) with 83.5 MHz bandwidth.

As discussed above, the miniature size and multi-channel are essential factors for the antenna. However, since multiple radiators of different frequency bands are all formed on the same substrate, interference problems existing among the radiators is another critical issue for consideration. As a result, the practical development of the antenna must simultaneously take into account many aspects including the size and performance.

The antenna of the wireless communication products can be distinguished into the external type and the internal type based on their installation position. The most commonly used external type antenna has a circular appearance if the antenna is created as a spiral configuration. To vary the appearance of the antenna, the flat structure is suitable for forming a rectangular, square or an elliptical antenna.

Moreover, the chip type antenna also can be implemented by the flat structure. The antenna can be electrically mounted on a desired circuit board by the surface mounting technology (SMT) thus reducing the cost of packaging and connecting processes. Consequently, the flat structure is quite suitable for use as an internal type antenna.

SUMMARY OF THE INVENTION

An objective of the present invention is to provide a flat antenna with multiple operation frequency bands, where the bandwidth of the second frequency band is effectively used and the size of the antenna is minimized as far as possible.

To accomplish the objective, the flat antenna comprises:

multiple dielectric substrates;

a first radiation unit created on at least two of the multiple dielectric substrates and operated in a first operation band, wherein the first radiation unit is constituted of differently-patterned conductive circuits that are electrically connected to form a three-dimensional meandering configuration; and a second radiation unit formed by conductive circuits and created on one of the multiple dielectric substrates where the conductive circuits of the first radiation unit are formed, wherein the second radiation unit is operated in a second operation band;

wherein the first radiation unit and the second radiation unit are connected together at a common feeding node, wherein the connected first and second radiation units are further connected to a first feeding port through a signal transmission wire;

a third radiation unit formed by a conductive crooked circuit on one of the multiple substrates where no conductive circuits of the first and the second radiation units are formed, wherein the third radiation unit is operated in a third operation band, wherein a position the crooked circuits form corresponds to that of the signal transmission wire.

With such a configuration, by properly changing the circuit lengths of the first/second radiation units as well as the third radiation unit, the desired resonance frequency values and their ratio can be easily acquired, and the second frequency band can reach to a 460 MHz bandwidth. Further, since the third radiation unit is arranged in a position to correspond to the signal transmission wire, the couple effect and the volume of the antenna can be controlled to a desired extent without sacrificing the performance.

Another objective of the present invention is to provide a flat antenna with multiple operation bands, which can serve as an external type antenna or an internal type antenna.

To form the external type antenna, the preferable material of the dielectric substrates could be glass fiber or Teflon™ so as to create a desired appearance such as a rectangular, a square or an elliptical antenna. Moreover, since the flat antenna itself is able to function as a supporting member and a signal feeding port, the cost for fabricating the supporting member and the signal feeding port is thus low.

To form the internal type antenna, the preferable material for the dielectric substrates could be glass fiber or ceramic thus creating an internal type antenna suitable for surface mounting technology.

Other objects, advantages and novel features of the invention will become more apparent from the following detailed description when taken in conjunction with the accompanying drawings.

DETAILED DESCRIPTION OF THE PREFERRED EMBODIMENT

Figure 6:
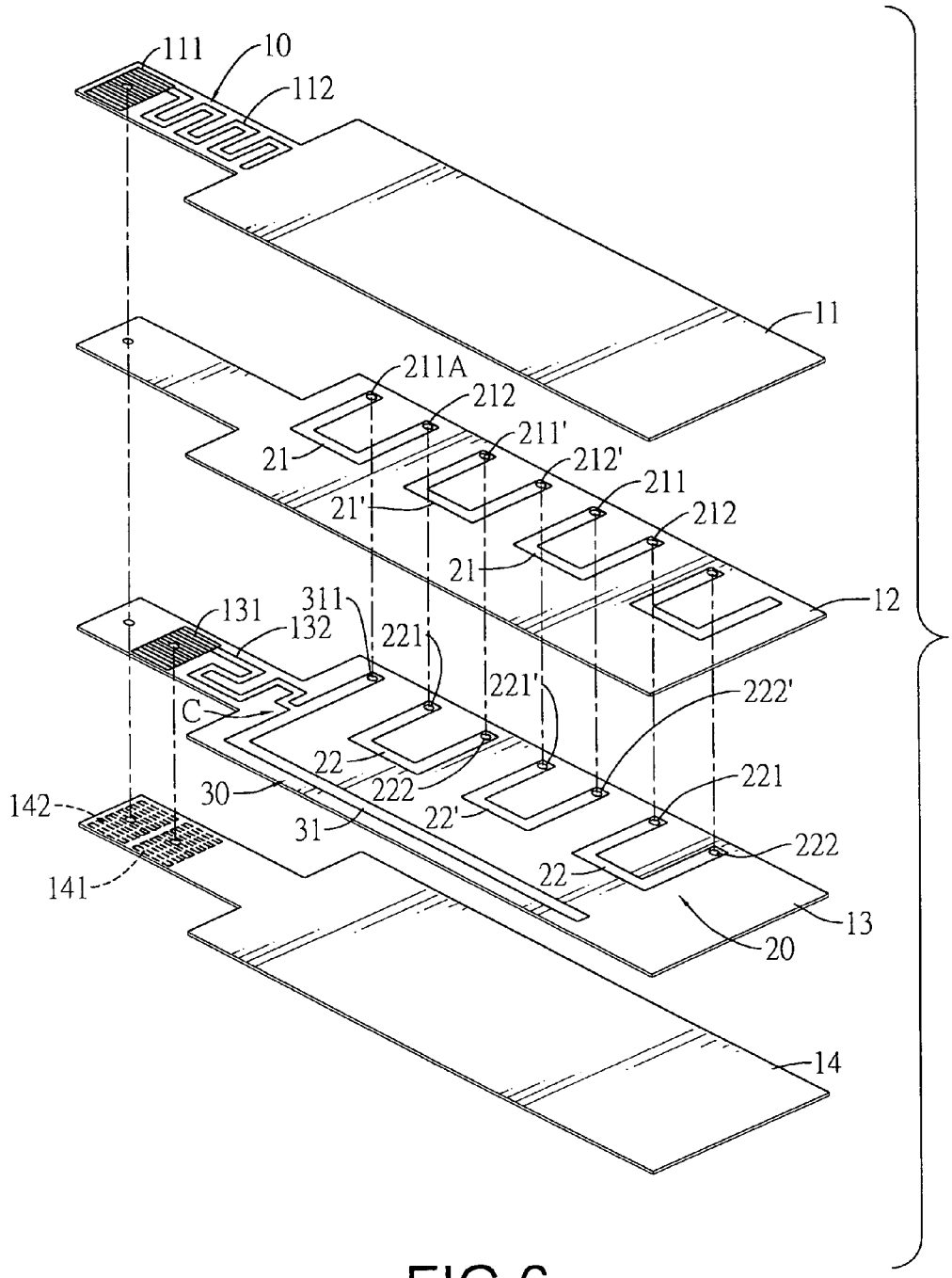
FIG. 6 is an exploded perspective view of a flat antenna according to a first embodiment of the present invention.

With reference to FIG. 6, a first embodiment of a multi-band flat antenna of the present invention has a construction that is composed of plural substrates (11–14) constituted of ceramic, glass fiber, Teflon™ or other dielectric materials. A first radiation unit (20) to be operated in a first frequency band, a second radiation unit (30) to be operated in a second frequency band, and a third radiation unit (10) to be operated in a third frequency band are formed on these substrates (11–15).

The top substrate (11) serves as a base for carrying the third radiation unit (10) thereon. The bottom substrate (14) is an isolating layer, wherein two external feeding ports (141)(142) are formed on a protrusion extending from one edge of the bottom substrate (14). The first external feeding port (141) serves as a signal feeding terminal for the first and second radiation units (20)(30). The second external feeding port (142) functions as a signal feeding terminal for the third radiation unit (10).

The first radiation unit (20) is composed of multiple conductive circuits (21,22) formed on the different layers of the substrates (12,13). The circuits (21–22) can be configured to different shapes including a U-shaped, an inverted U-shaped, a V-shaped or an inverted V-shaped circuit. In this embodiment, the conductive circuits (21,22) are U-shaped. The two groups of circuits (21) and (22) are respectively formed on the adjacent substrates (12,13) and stagger from each other if they would otherwise overlap on the same plane. Two distal ends (221, 222) of each U-shaped circuit (22) on the substrate (13) are for respective connection to a first distal end (211, 212) of two respective adjacent circuits (21) on the substrate (12). After the substrates (11–14) are combined and compressed together, an interconnection means is applied on these substrates (11–14) to electrically connect the distal ends of the circuits (21, 22) in series. The interconnection means is implemented, for example by forming holes through the substrates (11–14) and electroplating these holes, as by for example the well known "PTH" process.

Therefore, the distal end (212) of the first U-shaped circuit (21) positioned at the left-most side on the substrate (12) is electrically connected to the distal end (221) of the first U-shaped circuit (22) positioned at the left-most side on the substrate (13). The other distal end (222) of the first inverted U-shaped circuit (22) is connected to a distal end (211') of a second circuit (21') adjacent to the first circuit (21). Similarly, the other distal end (212') of that second circuit (21') is connected to a distal end (221') of a second U-shaped circuit (22). By repeating the foregoing connection, the first radiation unit (20) forms a three-dimensional meandering structure.

The second radiation unit (30) is formed by an L-shaped circuit (31) with a short trace and a long trace, where the L-shaped circuit (31) keeps a predetermined distance away from the first radiation unit (20) whereby the frequency couple effect between the two radiation units (30) can be reduced. The L-shaped circuit (31) is formed by printing a conductive trace on the substrate (13). A distal end (311) of the short trace of the L-shaped circuit (31) is electrically connected to the distal end (211A) of the first U-shaped circuit (21) formed on the second substrate (12). A common feeding node (C) is thus formed where the first and second radiation units (20,30) are connected.

Further, an internal feeding port (131) extending from one edge of the substrate (13) is also electrically connected to the first external feeding port (141) of the bottom substrate (14) through the interconnection means. As shown in this embodiment, the internal feeding port (131) is connected to the short trace of the L-shaped circuit (31) by a signal transmission circuit (132) formed by a printing process. The purpose of the crooked pattern of the signal transmission circuit (132) is for adjusting the resonance frequency of the first operation band and the second operation band.

The third radiation (10) is formed by a crooked conductive circuit (112) printed on the substrate (11). A first end of the crooked conductive circuit (112) is in an open circuit status, and a second end is connected to a top feeding port (111) created on the same substrate (11). The top feeding port (111) interconnects to the second external feeding port (142) of the bottom substrate (14). The third radiation (10) keeps a proper distance in altitude away from the crooked signal transmission circuit (132) so that the couple effect between them can be reduced. In this embodiment, the thickness of the substrate (12) interleaved between the third radiation unit (13) and the crooked signal transmission circuit (132) provides the proper interval.

As discussed above, the antenna of the present invention provides three radiation units with different operation bands. Although the operation bands are expanded by increasing the amount of the radiation units, the frequency couple effect among these radiation units should also be considered. The way to mitigate the couple effect between the first and second radiation units has been discussed above. With respect to the third radiation unit, the couple effect is reduced by forming the third radiation unit and the crooked signal transmission circuit on different substrates but properly overlapping both to each other.

Figure 7:
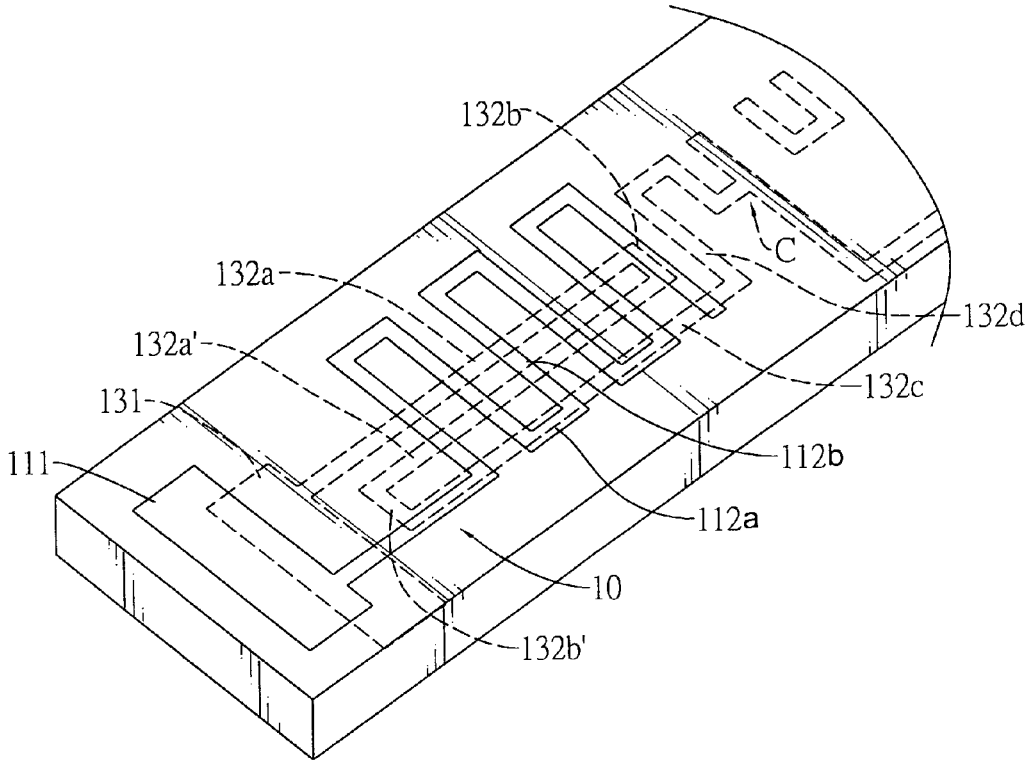
FIG. 7 is a perspective view showing relative positions of a third radiation unit and a signal transmission circuit according to a first embodiment.
Figure 8:
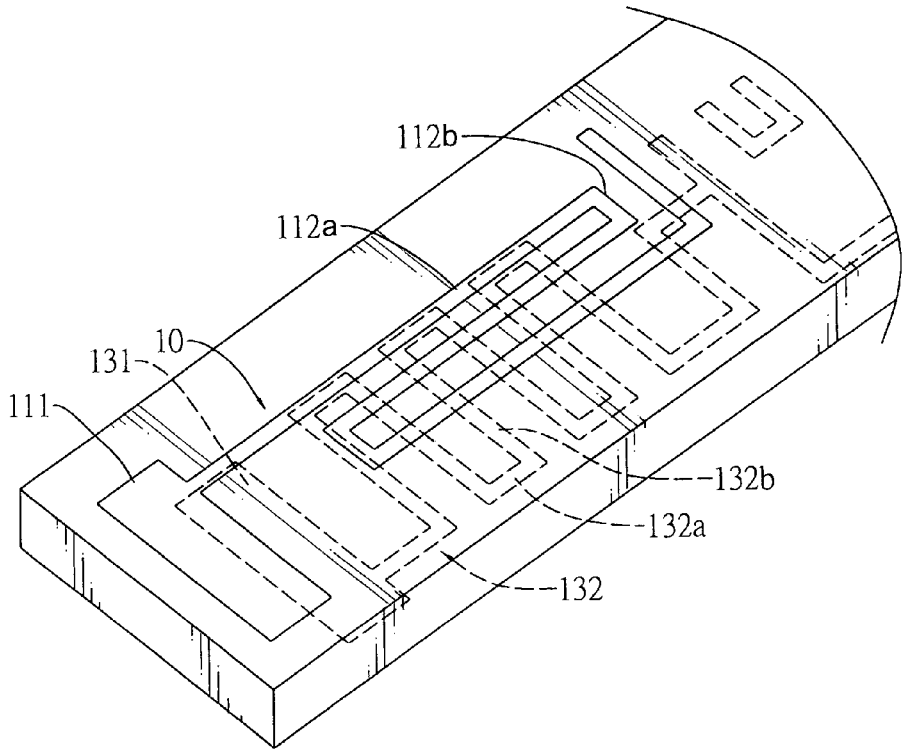
FIG. 8 is a perspective view showing relative positions of a third radiation unit and a signal transmission circuit according to a second embodiment.

With reference to FIGS. 7 to 9, there are three preferable embodiments showing the configurations of the third radiation unit (10) and the crooked signal transmission circuit (132) capable of reducing the couple effect.

Firstly, as shown in FIG. 7, both the third radiation unit (10) and the crooked signal transmission circuit (132) are formed by multiple L-shaped conductive segments connected together. Each L-shaped segment of the third radiation unit (10) is composed of a lengthwise wire (112*a*) and a lateral wire (112*b*) that is longer than the lengthwise wire (112*a*).

Contrary to the L-shaped segment of the third radiation unit (10), each L-shaped segment of signal transmission circuit (132) is composed of a lengthwise wire (132*a*) and a lateral wire (132*b*) that is shorter than the lengthwise wire (132*a*). A distal end of the lateral wire (132*b*) is connected to a distal end of a second lengthwise wire (132*a*'). A second lateral wire (132*b*'), extending from the second lengthwise wire (132*a*'), is connected to a third lengthwise wire (132*c*). The third lengthwise wire (132*c*) is parallel to the two lengthwise wires (132*a*)(132*a*'). The distal end of the third lengthwise wire (132*c*) extends to the common feeding node (C) where the first and second radiation units (20,30) are connected. The lateral wires (112*b*) of the third radiation unit (112) and the lengthwise wires (132*a*) of the signal transmission circuit (132) are arranged to cross each other. As a result the couple effect is able to be effectively mitigated.

Secondary, with reference to FIG. 8, both the third radiation unit (10) and the crooked signal transmission circuit (132) are also formed by multiple L-shaped conductive segments connected together. Each L-shaped segment of the third radiation unit (10) is composed of a lengthwise wire (112*a*) and a lateral wire (112*b*) that is shorter than the lengthwise wire (112*a*). Each L-shaped segment of signal transmission circuit (132) is composed of a lengthwise wire (132*a*) and a lateral wire (132*b*) that is longer than the lengthwise wire (132*a*). It is noted that the configuration of FIG. 8 is formed by exchanging the third radiation unit (10) and the signal transmission circuit (132) of FIG. 7. Therefore, this embodiment still can achieve the same effect as that shown in FIG. 7.

Figure 9A:
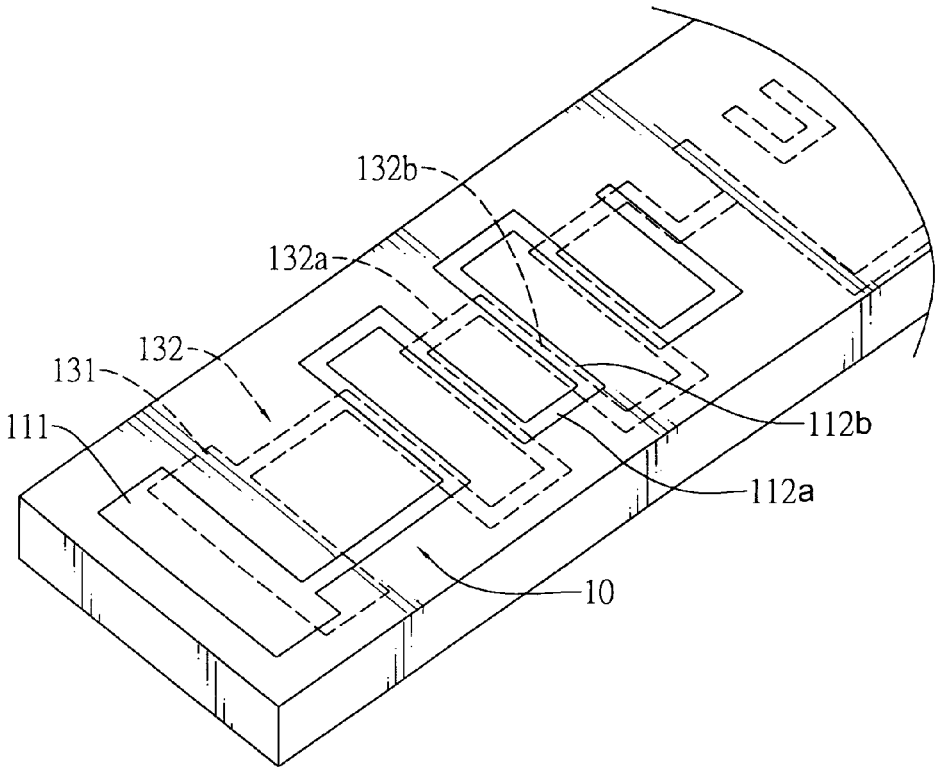
FIG. 9A is a perspective view showing relative positions of a third radiation unit and a signal transmission circuit according to a third embodiment.
Figure 9B:
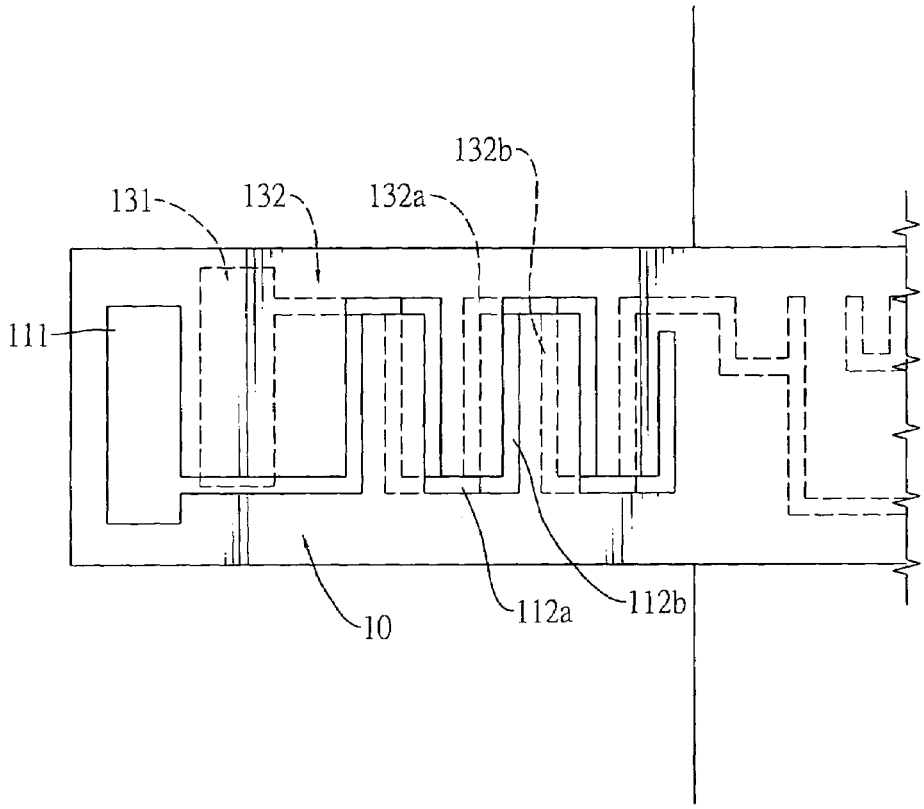
FIG. 9B is top plan view of FIG. 9A.

Thirdly, with reference to FIGS. 9A and 9B, both the third radiation unit (10) and the crooked signal transmission circuit (132) are also formed by multiple L-shaped conductive segments connected together. Each L-shaped segment of the third radiation unit (10) is composed of a lengthwise wire (112*a*) and a lateral wire (112*b*) that is longer than the lengthwise wire (112*a*). Each L-shaped segment of signal transmission circuit (132) is composed of a lengthwise wire (132*a*) and a lateral wire (132*b*) that is longer than the lengthwise wire (132*a*).

It is noted that the lateral wires (112*b*)(132*b*) are parallel to each other but not overlapped. However, each lengthwise wire (112*a*) of the third radiation unit (10) provides a part to be overlapped with a part of a respective lengthwise wire (132*a*). This couple effect still can be effectively mitigated in accordance with this embodiment.

It is to be noted that by properly changing the circuit lengths of the first radiation unit (20) and the third radiation unit (10), and the circuit length of the second radiation unit (30), desired resonance frequency values and their ratio can be easily acquired. More particularly, by arranging the three units in an orthogonal configuration, placing the specific circuits in parallel to or overlapped with others, the electromagnetic couple effect is reduced. In other words, the performance of the multi-band flat antenna and its size are both well considered.

Figure 1:
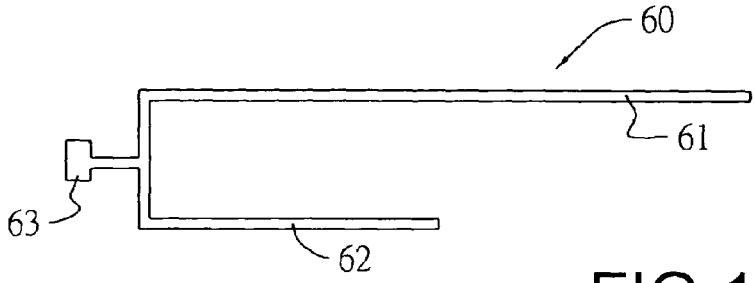
FIG.1 PRIOR ART
FIG. 1 is a plan view of a conventional dual-band antenna.
Figure 2:
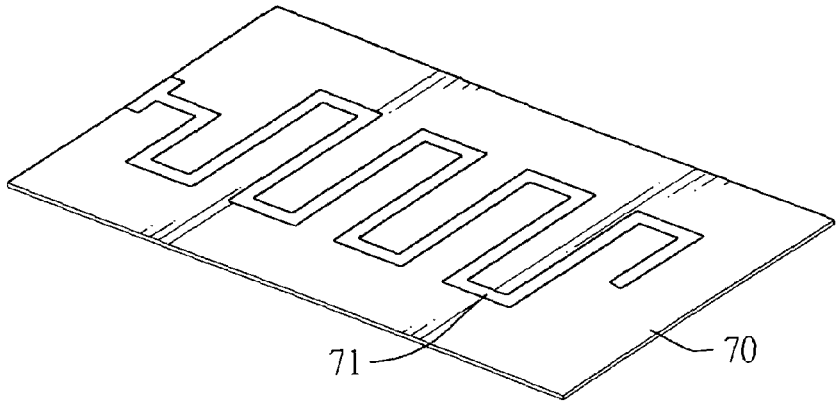
FIG.2 PRIOR ART
FIG. 2 is a perspective view of a conventional flat antenna with a meandering radiator.
Figure 3:
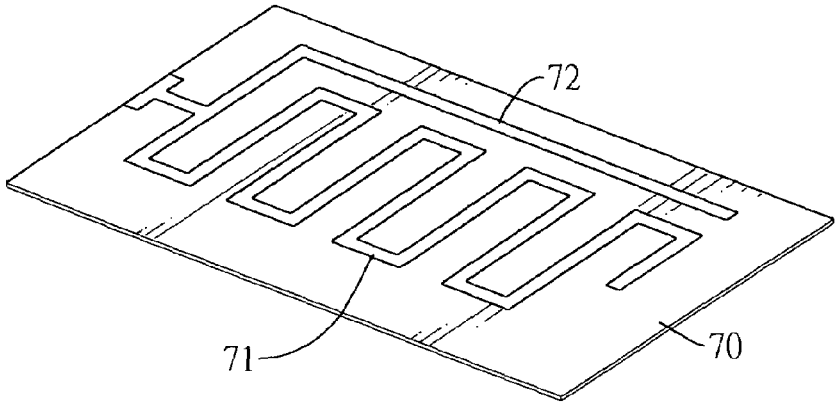
FIG.3 PRIOR ART
FIG. 3 is a perspective view of a conventional dual-band flat antenna including the meandering radiator of FIG. 2.
Figure 4:
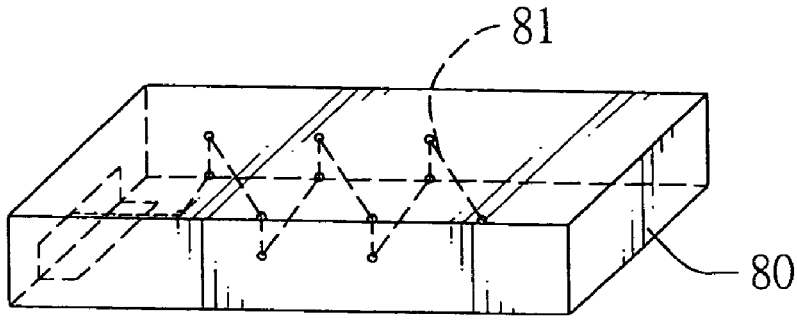
FIG.4 PRIOR ART
FIG. 4 is a perspective view of a conventional solid antenna embedded with a spiral conductive wire.
Figure 5:
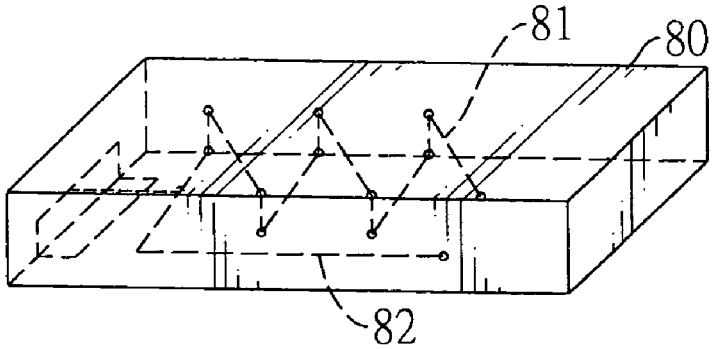
FIG.5 PRIOR ART
FIG. 5 is a perspective view of a conventional dual-band solid antenna including the spiral conductive wire of FIG. 4.
Figure 10:
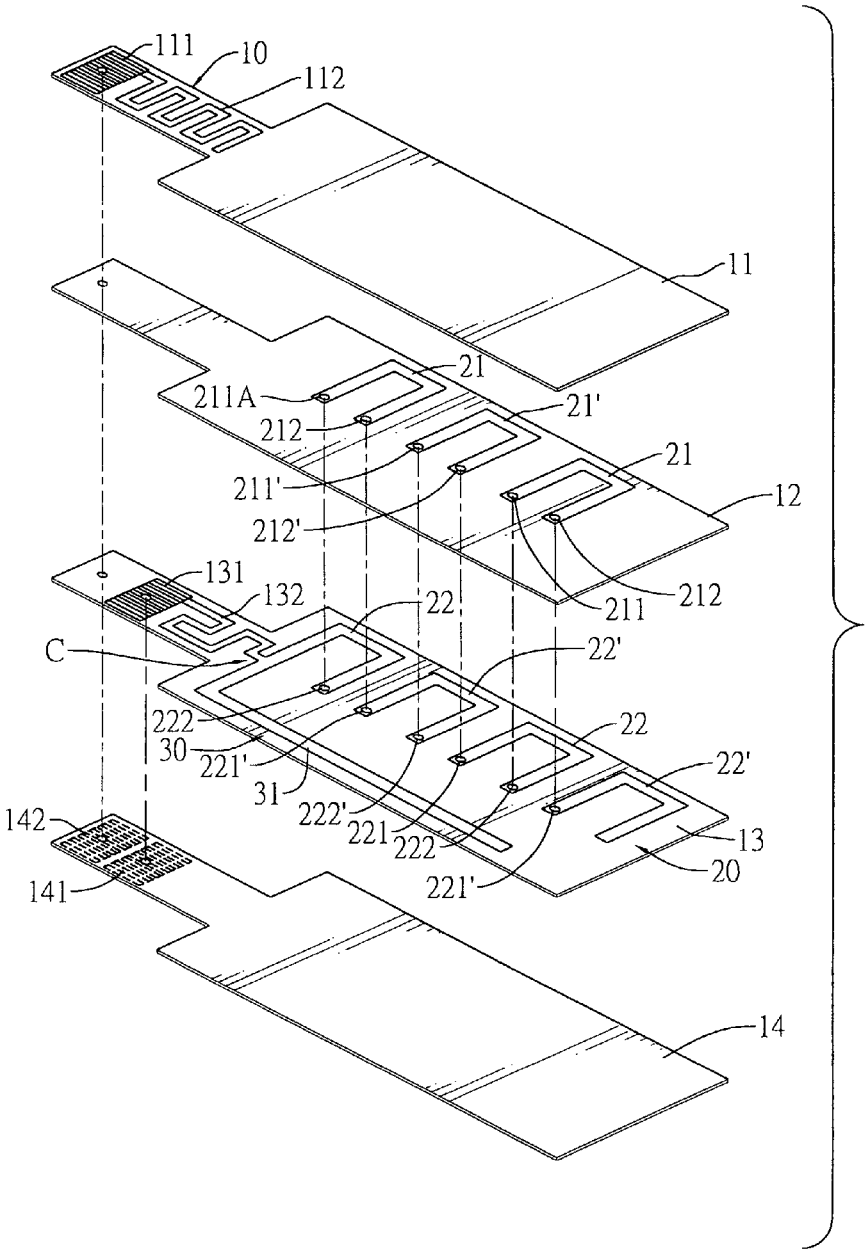
FIG. 10 is an exploded perspective view of a flat antenna according to a second embodiment of the present invention.

With reference to FIG. 10, the second embodiment of the multi-band flat antenna is substantially the same as the first embodiment of FIG. 1. The difference is that the U-shaped circuits of the first radiation unit (20) are replaced by inverted U-shaped circuits distributed on the substrates (12)(13) and interconnected in a meandering configuration.

The second radiation unit (30) in this embodiment is formed by an L-shaped conductive circuit (31) on the substrate (13) where the inverted U-shaped circuits (22) of the first radiation unit (20) are formed. A distal end of the short trace of the L-shaped circuit (31) is electrically connected to the distal end of the first inverted U-shaped circuit (22) printed on the substrate (13). The other end (222) of the circuit (22) is interconnected to a first end (211A) of a first inverted U-shaped circuit (21) printed on the second substrate (12), whereby the two radiation units (20)(30) are electrically connected at the common node (C).

An internal feeding port (131) extending from one edge of the third substrate (13) electrically connects to an external feeding port (141) on the fourth substrate (14). The connection between the feeding port (131) and the two radiation units (20,30) can be implemented by a signal transmission circuit (132). The pattern of the signal transmission circuit (132) could be a crooked line. Also, the flat antenna has the same performance as the first embodiment to effectively mitigate the couple effect.

Figure 11:
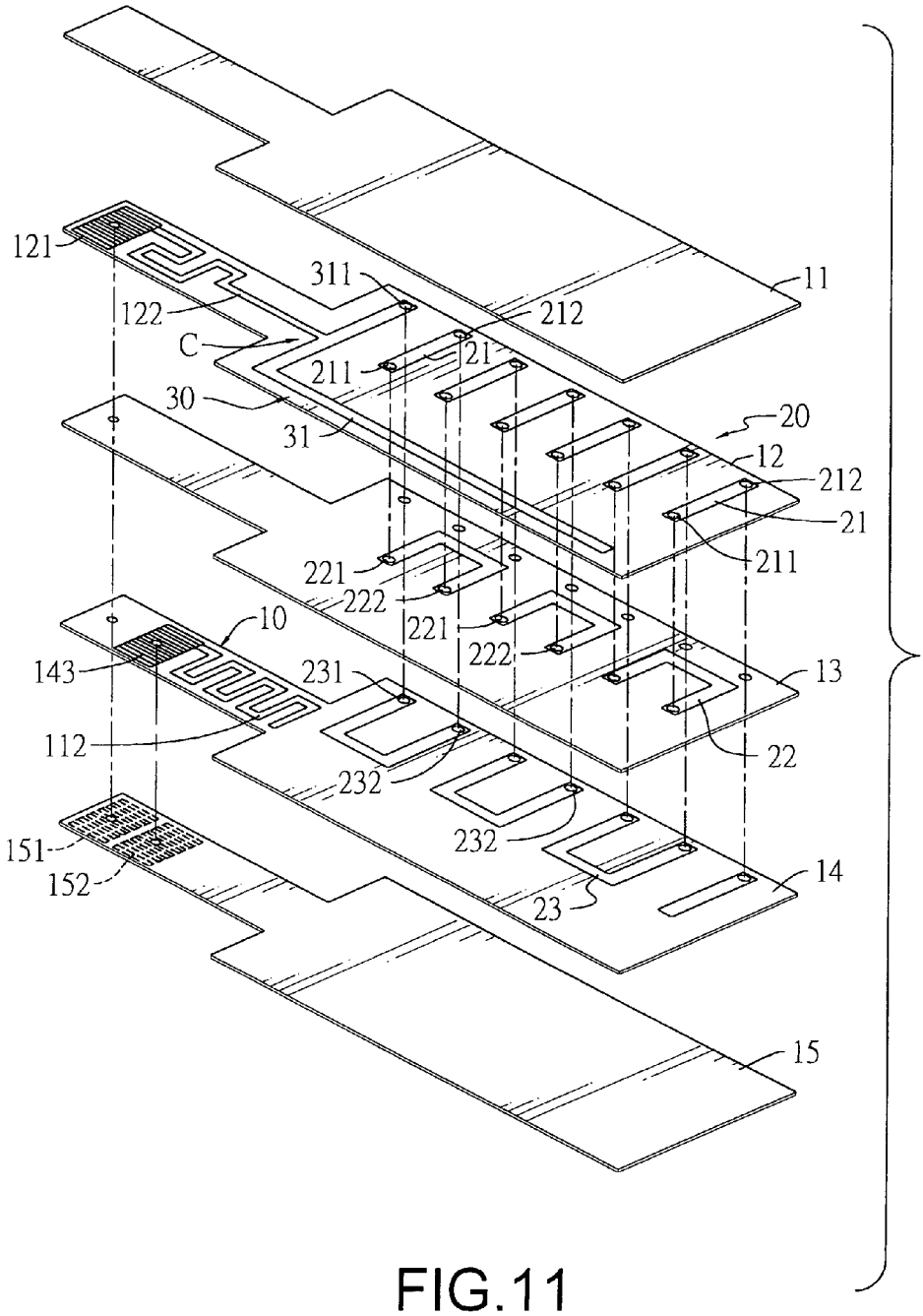
FIG. 11 is an exploded perspective view of a flat antenna according to a third embodiment of the present invention.

With reference to FIG. 11, a third embodiment of the multi-band flat antenna is also similar to two previous embodiments. The changed portion is that straight line circuits (21), inverted U-shaped circuits (22) and U-shaped circuits (23) of the first radiation unit (20) are sequentially formed on a second, third and fourth substrates (12–14), where these circuits (21–23) are also interconnected to each other to configure the three-dimensional structure by the PTH interconnecting process.

Two distal ends (221)(222) of an inverted U-shaped circuit (22) are respectively connected to distal ends (211) of two adjacent straight circuits (21). The other distal ends (212) of the straight circuits (21) are connected to the ends (232)(231) of the U-shaped circuits (23). When all the substrates (11–15) are compressed, all the circuits (21–23) are interconnected by PTH processes. Consequently, the second end (232) of the first U-shaped circuit (23) at the left-most side of the substrate (14) can connect to the second end (212) of the first straight line (21) at the left-most side of the substrate (12). The first end (211) of the first straight line (21) is subsequently connected to the first end (221) of the first inverted U-shaped circuit (22) at the left-most side of the substrate (13). The second end (222) of the first inverted U-shaped circuit (22) then connects to the first end (211) of the second straight circuit (21). The second end (212) of the second straight circuit (21) is connected to the first end (231) of the second U-shaped circuit (23). By repeating the foregoing process to connect all circuits (21–23), a flat antenna with a three-dimensional meandering radiator is created.

The second radiation unit (30) still constituted of an L-shaped trace is printed on the second substrate (12) where the straight line circuits (21) are formed. The distal end (311) of the L-shaped circuit (31) is connected to the distal end (231) of the U-shaped circuit (23) on the fourth substrate (14), whereby a common feeding node (C) where the first/second radiation units (20)(30) join together is formed.

An internal feeding port (121) extending from one edge of the second substrate (12) electrically connects to an external feeding port (151) on the fifth substrate (15). The connection between the internal feeding port (121) and the common feeding node (C) is implemented by a signal transmission circuit (122), where the signal transmission circuit (122) can be a crooked line.

The third radiation unit (10) is formed by a crooked conductive circuit (112) on the fourth substrate (14). The crooked conductive circuit (112) corresponds to the signal transmission circuit (122) of the second substrate (12). One distal end of the crooked conductive circuit (112) is in an open circuit status, while the other distal end is connected to an internal feeding port (143) on the same layer.

It is noted that any group of the previous three kinds of circuits (21–23) can be formed on any layer (12–14), while the other two groups of circuits (21–23) are respectively formed on the rest of the two layers (12–14). Even though the circuits (21–23) are no longer sequentially formed on the second to fourth layers (12–14), the flat antenna still has the superior performance as the previously discussed embodiments.

Figure 12:
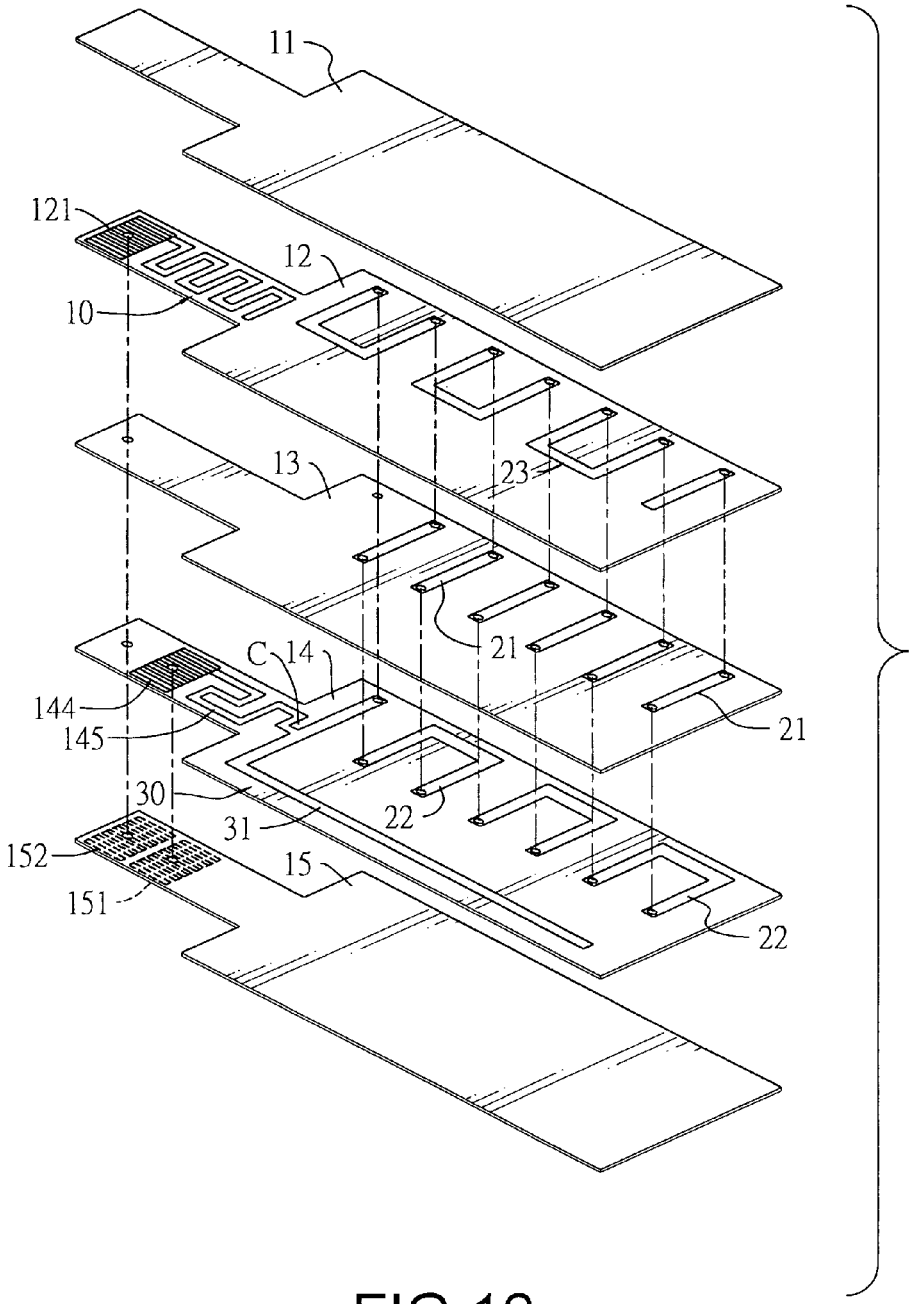
FIG. 12 is an exploded perspective view of a flat antenna according to a fourth embodiment of the present invention.

For example, with reference to FIG. 12, a fourth embodiment of the flat antenna is substantially the same as the foregoing embodiments. The first radiation unit (20) is also created by the U-shaped circuits (23), the straight circuits (21) and the inverted U-shaped circuits (22) that are sequentially formed on the second to the fourth substrates (12–14) and interconnected in a meandering configuration.

The second radiation unit (30) forms an L-shaped trace on the fourth substrate (14). An internal feeding port (144) formed on the same substrate (14) is connected to the second radiation unit (30) through a signal transmission circuit (145). The internal feeding port (144) is further connected to a first external feeding port (151) on the bottom substrate (15) by PTH processes.

The third radiation unit (10) formed on the second substrate (12) has one end connected to an internal feeding port (121), and the other end is kept in the open circuit status. The internal feeding port (121) is connected to the second external feeding port (152) on the bottom plate (15) by PTH processes. The first and second external feeding ports (151)(152) respectively serve as a signal feeding terminal for the third radiation unit (10) and for the first/second radiation units (20)(30).

Figure 13:
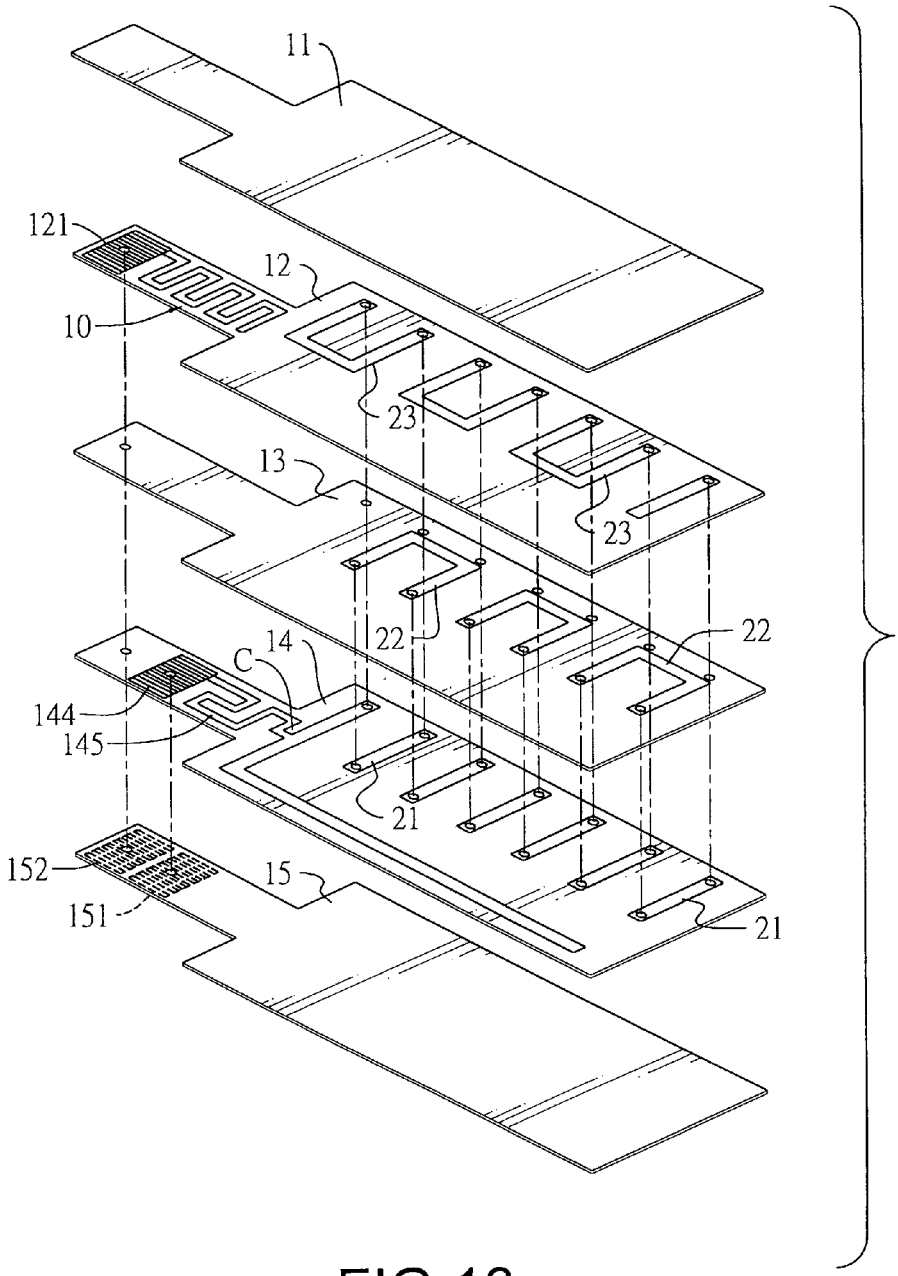
FIG. 13 is an exploded perspective view of a flat antenna according to a fifth embodiment of the present invention.

With reference to FIG. 13, a fifth embodiment is substantially the same as the third and fourth embodiments. The first radiation unit (20) is composed of U-shaped circuits (23), inverted U-shaped circuits (22) and straight circuits (21) that are sequentially formed on the second to the fourth substrates (12–14) and interconnected in a meandering configuration.

Figure 14:
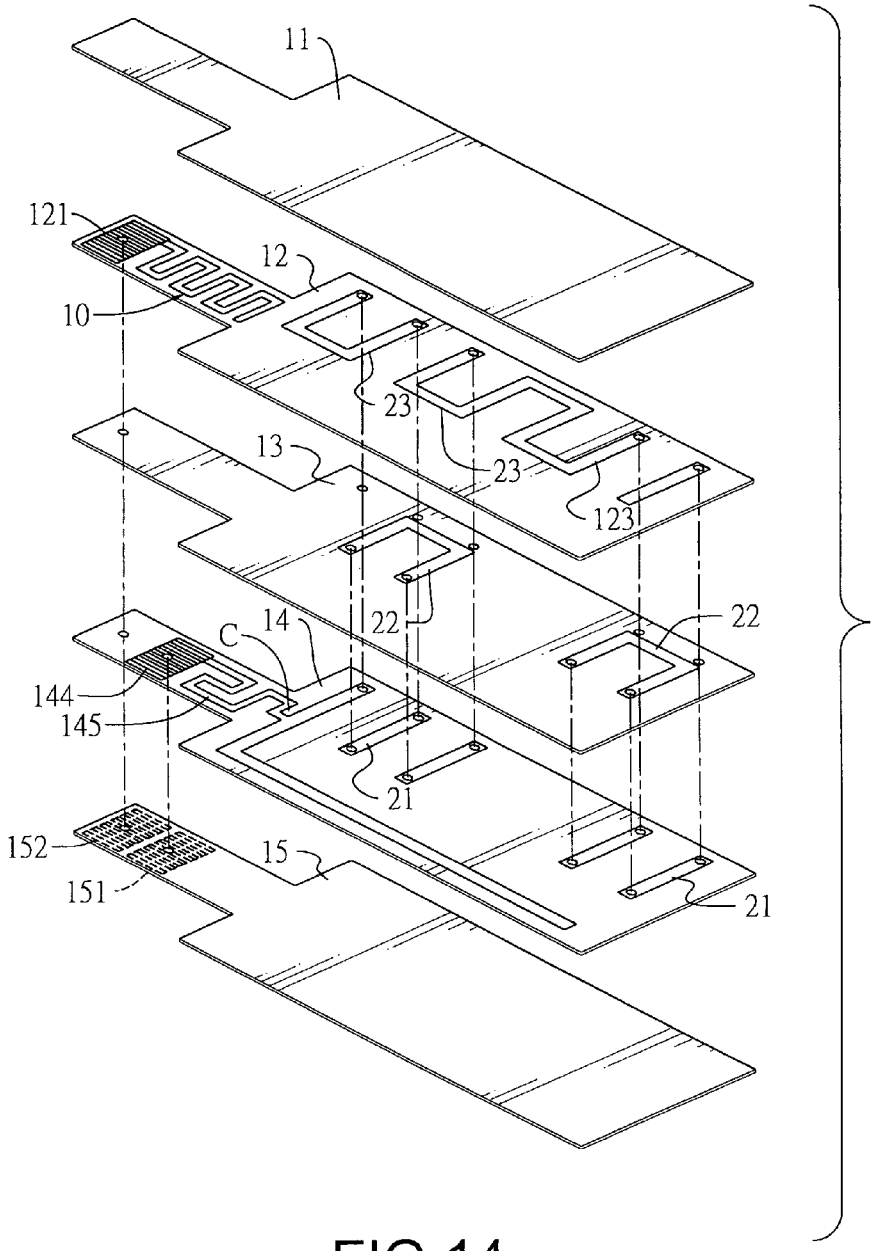
FIG. 14 is an exploded perspective view of a flat antenna according to a sixth embodiment of the present invention.

With reference to FIG. 14, a sixth embodiment is substantially the same as the fifth embodiment. The modification is that a flat crooked circuit can be inserted on any substrate and connect two adjacent circuits together to fine tune the operation band of the first radiation unit (20). In this embodiment, the first radiation unit (20) includes circuits (21–23) formed on the substrates (12–14) and interconnected in a meandering configuration, wherein a flat crooked circuit (123) is inserted between the adjacent circuits (23) on the second substrate (12). The crooked circuit (123) is formed by multiple L-shaped wires connected in series.

The material for the conductive circuits mentioned in each embodiment can be gold, silver, copper or other metals.

Figure 15:
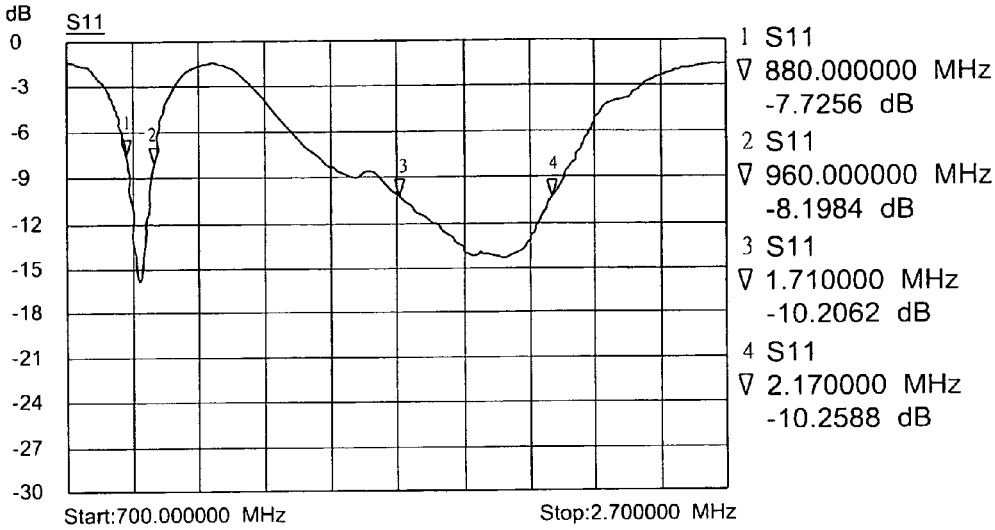
FIG. 15 shows graph of the return loss versus the operation frequency of the first and second radiation units.

With reference to FIG. 15, the experiment result shows the bandwidth and return loss of the first and second radiation units in accordance with the first embodiment. A first measured return loss value is approximate to −7.72 dB while the operation frequency is 880 MHz (as shown at the point designated by numeral "1"). A second measured return loss value is approximate to −8.19 dB while the operation is 960 MHz (as shown at the point designated by numeral "2"). Within the range from 880 MHz to 960 MHz, the first frequency band has an 80 MHz bandwidth.

At the frequency 1710 MHz, the approximate measured return loss value is −10.20 dB (as shown at the point designated by numeral "3"). At the frequency 2170 MHz, the approximate measured return loss value is −10.25 dB indicated by numeral "4". Within the range from 1710 MHz to 2170 MHz, the second frequency band has a 460 MHz bandwidth.

Figure 16:
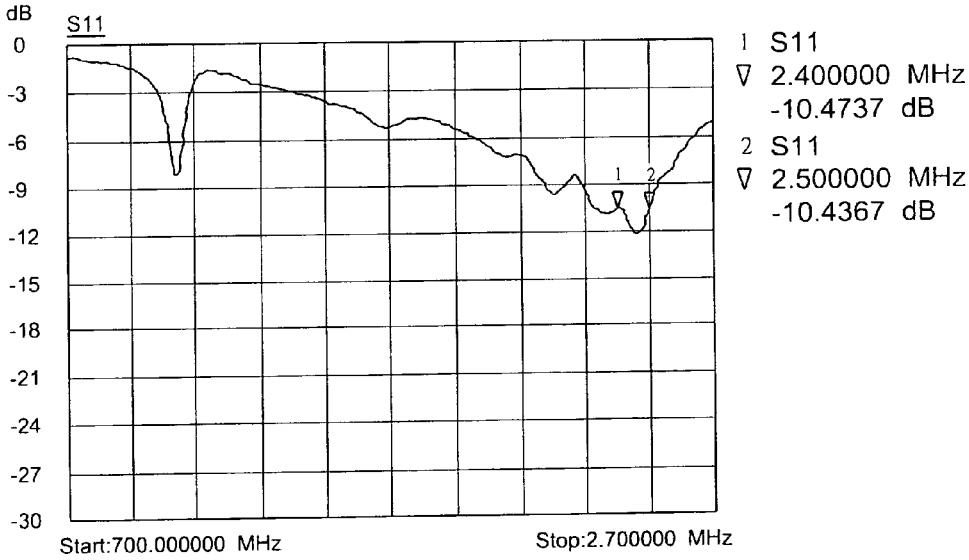
FIG. 16 shows graph of the return loss versus the operation frequency of the third radiation unit.

With reference to FIG. 16, the experiment result shows the bandwidth and return loss of the third radiation unit in accordance with the first embodiment. At the frequency 2.4 GHz, the approximate measured return loss value is −10.47 dB as shown at the point designated by numeral "1". At the frequency 2.5 GHz, the approximate measured return loss value is −10.43 dB indicated by numeral "2". Within the range from 2.4–2.5 GHz, the third frequency band has a 100 MHz bandwidth.

Figure 17:
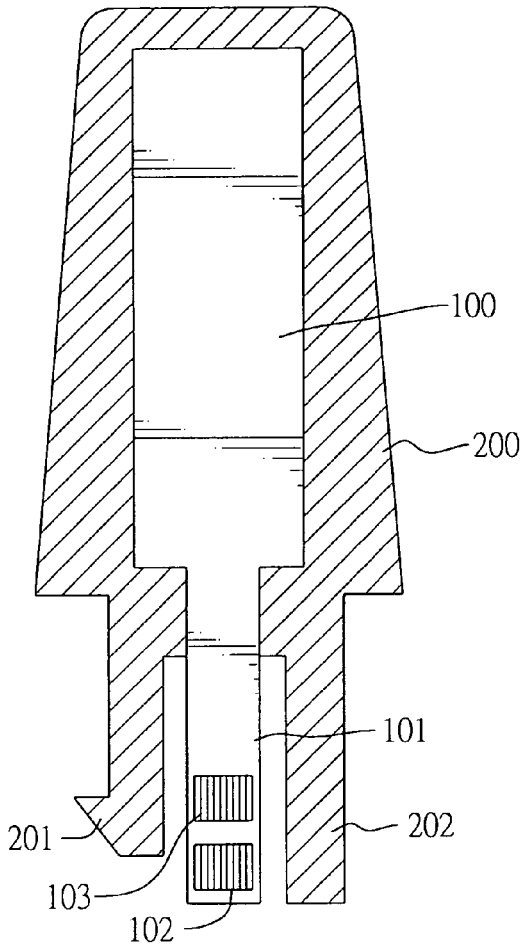
FIG. 17 is a cross section view of a packed flat antenna.

As shown in FIG. 17, the flat antenna (100) in accordance with the present invention is surrounded by a hollow body (200) constituted of insulating material. As mentioned above, the material for the substrates could be glass fiber or Teflon™ so as to form different appearances, such as a rectangular shape, a square shape or an elliptical shape. An extending portion (101) is exposed from the hollow body (200) and external feeding ports (102)(103) are formed on the extending portion (101). The extending portion (101) can serve as a support of the flat antenna (100) when the flat antenna (100) is installed on an electrical device (not shown). A guiding leg (202) and a hook (201) encircling the extending portion (101) are integrally formed at opposite sides of a bottom surface of the hollow body (200). When the flat antenna (100) together with the hollow body (200) is installed in a slot of the electrical device, the guiding leg (202) serves as an orientation element to guide the antenna assembly to be located in the proper position. Meanwhile, the hook (201) can secure the antenna assembly to the electrical device.

According to the foregoing description, the present invention provides a compact and low manufacturing cost flat antenna with multiple frequency bands, where the resonance frequency of the flat antenna is adjustable and the operation bandwidth of the second frequency band is effectively increased.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band flat antenna comprising:

multiple dielectric substrates;

a first radiation unit created on at least two of the multiple dielectric substrates and operated in a first operation band, wherein the first radiation unit is constituted of differently-patterned conductive circuits that are electrically connected to form a three-dimensional meandering configuration; and a second radiation unit formed by conductive circuits and created on one of the multiple dielectric substrates where the conductive circuits of the first radiation unit are formed, wherein the second radiation unit is operated in a second operation band;

wherein the first radiation unit and the second radiation unit are connected together at a common feeding node, wherein the connected first and second radiation units are further connected to a first feeding port through a signal transmission circuit;

a third radiation unit formed by a conductive crooked circuit on one of the multiple substrates different to the substrates on which the conductive circuits of the first and the second radiation units are formed, wherein the third radiation unit is operated in a third operation band, wherein a position the crooked circuits forms corresponds to that of the signal transmission circuit.

2. The multi-band flat antenna as claimed in claim 1, wherein the first and the second radiation units and the signal transmission circuit are formed on the same substrate, the substrate further has an internal feeding port formed thereon; wherein the second radiation unit has a first end kept in an open circuit status, and a second end connected to the conductive circuits of the first radiation unit, wherein the second end is further connected to the internal feeding port through the signal transmission circuit.

3. The multi-band flat antenna as claimed in claim 2, wherein each of the third radiation unit and the signal transmission circuit is a crooked circuit formed by connecting multiple L-shaped segments in series, each L-shaped segment has a long wire connected to a short wire, and the long wires of the third radiation unit are arranged to overlap the long wires of the signal transmission circuit in an orthogonal manner.

4. The multi-band flat antenna as claimed in claim 2, wherein each of the third radiation unit and the signal transmission circuit is a crooked circuit formed by connecting multiple L-shaped segments in series, each L-shaped segment has a long wire connected to a short wire, the long wires of the third radiation unit are arranged to parallel to the long wires of the signal transmission circuit, and each short wire of the third radiation unit provides a half part to be overlapped on a half part of a respective short wire of the signal transmission circuit.

5. The multi-band flat antenna as claimed in claim 2, wherein a bottom substrate of the multiple dielectric substrates forms a first external feeding port and a second feeding port, and the first external feeding port is interconnected to the internal feeding port as a common feeding port for the first and second radiation units.

6. The multi-band flat antenna as claimed in claim 3, wherein a bottom substrate of the multiple dielectric substrates forms a first external feeding port and a second feeding port, and the first external feeding port is interconnected to the internal feeding port as a common feeding port for the first and second radiation units.

7. The multi-band flat antenna as claimed in claim 4, wherein a bottom substrate of the multiple dielectric substrates forms a first external feeding port and a second feeding port, and the first external feeding port is interconnected to the internal feeding port as a common feeding port for the first and second radiation units.

8. The multi-band flat antenna as claimed in claim 5, wherein the conductive crooked circuit of the third radiation unit is formed on a substrate different to the layer on which the signal transmission circuit is formed, the conductive crooked circuit of the third radiation unit has a first end kept in an open circuit status and a second end connected to a second feeding port, wherein the second feeding port interconnects to the second external feeding port.

9. The multi-band flat antenna as claimed in claim 6, wherein the conductive crooked circuit of the third radiation unit is formed on a substrate different to the layer on which the signal transmission circuit is formed, the conductive crooked circuit of the third radiation unit has a first end kept in an open circuit status and a second end connected to a second feeding port, wherein the second feeding port interconnects to the second external feeding port.

10. The multi-band flat antenna as claimed in claim 7, wherein the conductive crooked circuit of the third radiation unit is formed on a substrate different to the layer on which the signal transmission circuit is formed, the conductive crooked circuit of the third radiation unit has a first end kept in an open circuit status and a second end connected to a second feeding port, wherein the second feeding port interconnects to the second external feeding port.

11. The multi-band flat antenna as claimed in claim 8, wherein a distance equal to a thickness of at least one substrate exists between the third radiation unit and the signal transmission circuit.

12. The multi-band flat antenna as claimed in claim 9, wherein a distance equal to a thickness of at least one substrate exists between the third radiation unit and the signal transmission circuit.

13. The multi-band flat antenna as claimed in claim 10, wherein a distance equal to a thickness of at least one substrate exists between the third radiation unit and the signal transmission circuit.

14. The multi-band flat antenna as claimed in claim 1, wherein a flat crooked conductive wire connects two adjacent conductive wires on any substrate of the first radiation unit, and the flat crooked conductive wire is formed by connecting multiple L-shaped wires in series.

15. The multi-band flat antenna as claimed in claim 1, wherein the meandering configuration of the first radiation unit is formed by the conductive circuits with a distal end to which a flat crooked conductive wire is connected in series, and the flat crooked conductive wire is formed by connecting multiple L-shaped wires in series.

16. The multi-band flat antenna as claimed in claim 1, wherein the conductive circuits of the first radiation unit comprises U-shaped or inverted U-shaped circuits.

17. The multi-band flat antenna as claimed in claim 1, wherein the conductive circuits of the first radiation unit comprises V-shaped or inverted V-shaped circuits.

18. The multi-band flat antenna as claimed in claim 1, wherein the conductive circuits of the first radiation unit comprises U-shaped, inverted U-shaped and straight circuits.

19. The multi-band flat antenna as claimed in claim 15, wherein after the dielectric substrates are combined and compressed together, the conductive wires on the dielectric substrates are interconnected.

20. The multi-band flat antenna as claimed in claim 16, wherein after the dielectric substrates are combined and compressed together, the conductive wires on the dielectric substrates are interconnected.

* * * * *